US007974572B2

(12) United States Patent
Suzuki

(10) Patent No.: US 7,974,572 B2
(45) Date of Patent: Jul. 5, 2011

(54) BROADCAST RECEIVER AND PROCESSING PROGRAM THEREOF

(75) Inventor: Katsumi Suzuki, Oume (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 739 days.

(21) Appl. No.: 12/012,894

(22) Filed: Feb. 6, 2008

(65) Prior Publication Data

US 2008/0220758 A1 Sep. 11, 2008

(30) Foreign Application Priority Data

Mar. 9, 2007 (JP) ..... 2007-060247

(51) Int. Cl.
*H04H 40/00* (2008.01)

(52) U.S. Cl. ..... 455/3.06; 455/3.04; 455/550.1; 455/556.1; 725/30; 725/44; 725/62

(58) Field of Classification Search ..... 455/3.01, 455/3.04, 550.1, 556.1; 725/30, 37, 44–47, 725/58, 62

See application file for complete search history.

(56) References Cited

U.S. PATENT DOCUMENTS

| | | | | |
|---|---|---|---|---|
| 6,185,360 | B1 * | 2/2001 | Inoue et al. | 386/46 |
| 2009/0007184 | A1 * | 1/2009 | Nakamura et al. | 725/58 |

FOREIGN PATENT DOCUMENTS

| | | |
|---|---|---|
| JP | 05-103068 | 4/1993 |
| JP | 2003-309792 | 10/2003 |
| JP | 2005-341479 | 12/2005 |
| JP | 2007-189352 | 7/2007 |

* cited by examiner

*Primary Examiner* — Edward Urban
*Assistant Examiner* — Fayyaz Alam
(74) *Attorney, Agent, or Firm* — Cohen Pontani Liberman & Pavane LLP

(57) ABSTRACT

When reservation information is inputted, a mobile terminal apparatus (broadcast receiver) 1 stores a mode ID for which the set flag is set at "1" and stored in a mode information memory section 1-3-1 and the inputted reservation information in the reservation information memory section 1-3-3. Subsequently, the apparatus 1 receives a television broadcast or a radio broadcast based on the reservation information. Then, the apparatus 1 judges whether or not the mode ID for which the set flag is set at "1" matches the mode ID that is stored in the reservation information memory section 1-3-3 in the manner so as to be associated with the reservation information. When both match each other, the apparatus 1 outputs the broadcast content to a speaker SP and a display section 1-7, and when both do not match each other, it outputs the broadcast content to a record data memory section 1-3-4.

14 Claims, 15 Drawing Sheets

FIG. 3

| MODE ID | NAME | FINGERPRINT INFORMATION | SET FLAG |
|---|---|---|---|
| 00 | INITIAL MODE | — | 0 |
| 01 | XX SATO | * * * * * * * | 1 |
| 02 | ZZ SATO | * * * * * * * | 0 |
| 03 | YY SATO | * * * * * * * | 0 |
| ... | ... | ... | ... |

FIG. 4

| MODE CHANGE | FLAG |
|---|---|
| TO CHANGE | 1 |
| NOT TO CHANGE | 0 |

FIG. 5

| MODE ID | RESERVATION ID | CLASSIFICATION | CHANNEL/FREQUENCY | TIME INFORMATION |
|---|---|---|---|---|
| 01 | 01 | TELEVISION | 8CH | 2008/10/10<br>10:00-12:00 |
| | 02 | RADIO | 81.3MHz | 2008/10/11<br>15:00-16:00 |
| | ... | ... | ... | ... |
| 02 | 01 | TELEVISION | 10CH | 2008/10/12<br>08:00-09:00 |
| | 02 | TELEVISION | 6CH | 2008/10/13<br>10:00-12:00 |
| | ... | ... | ... | ... |
| ... | ... | ... | ... | ... |

FIG. 6

| MODE ID | RECORD ID | CLASSIFICATION | CHANNEL/FREQENCY | TIME INFORMATION | VIDEO/VOICE DATA |
|---|---|---|---|---|---|
| 01 | 01 | TELEVISION | 4CH | 2008/10/01<br>21:00-22:00 | * * * * * * * * |
| | 02 | TELEVISION | 6CH | 2008/10/02<br>20:00-22:00 | * * * * * * * * |
| | ... | ... | ... | ... | ... |
| 02 | 01 | RADIO | 80.0MHz | 2008/10/03<br>08:00-10:00 | * * * * * * * * |
| | ... | ... | ... | ... | ... |
| ... | ... | ... | ... | ... | ... |

FIG. 14

| MODE ID | NAME | PASSWORD | SET FLAG |
|---|---|---|---|
| 01 | BUSINESS MODE | 0000 | 1 |
| 02 | HOME MODE | 1111 | 0 |
| 03 | OUT MODE | 5555 | 0 |
| ... | ... | ... | ... |

BROADCAST RECEIVER AND PROCESSING PROGRAM THEREOF

CROSS-REFERENCE TO RELATED APPLICATION

This application is based upon and claims the benefit of priority from the prior Japanese Patent Application No. 2007-060247, filed Mar. 9, 2007, the entire contents of which is incorporated herein by-reference.

BACKGROUND OF THE INVENTION

1. Field of the Invention

The present invention relates to a broadcast receiver and a processing program thereof.

2. Description of the Related Art

Some of electronic equipment such as a mobile terminal apparatus is equipped with a log-in function. The log-in function verifies passwords by comparing a password that has been registered in advance by a user of the electronic equipment with a password that is inputted by the user when he uses the electronic equipment, and when both passwords match, the operational mode is set from the operational mode that allows no one to use the electronic equipment to an operational mode that allows only this user to use it. Some electronic equipment uses biological information such as fingerprints of a user in place of a password.

Use of the log-in function enables prohibiting a person other than the user from using electronic equipment. In addition, a single unit of electronic equipment can be shared for use by a plurality of users by providing a plurality of operational modes for each of a plurality of users, verifying the passwords or the biological information, and subsequently setting an operational mode to the operational mode of the user having the matched password or biological information among the operational modes set for the individual users.

In addition, such electronic equipment also has a function that enables setting the operational mode to one of a plurality of operational modes in accordance with a usage of the user. Use of this function enables separating the data to be used for each usage, and limiting the function that can be used in accordance with a usage. For example, using operational modes for business, for home, and for going out separately enables separating the data for address book function and schedule function for business and for others, and enables limiting a television viewing function in the business operational mode.

As a conventional prior art in a multifunctional telephone that is used by a plurality of users, an art has been proposed of identifying individuals with fingerprints and other information for individual persons, and reads out the data for the identified person from the data that has been registered for individual persons (the telephone number of the counterpart, etc.) and performs automatic dialing. (See, for example, Japanese Laid-Open (Kokai) Patent Publication No. 05-103068.).

In the meantime, some of the recent mobile terminals also serve as a broadcast receiver having a television function and a radio function. The television function and the radio function receive a television broadcast and a radio broadcast, and output a broadcast content of a broadcast to a screen and a speaker. Then, the screen and the speaker replay the broadcast content that has been outputted.

Furthermore, some mobile terminals include a reservation function. In the reservation function, as the reservation information, information such as a broadcast time, a broadcast channel, a program name, or a product name in a commercial message of the broadcast content that the user wants to watch is stored in advance, and based on the reservation information, a broadcast is received. Then, the broadcast content of the broadcast is outputted to and replayed with the screen and the speaker, or is outputted to and recorded in the recording apparatus.

However, the following problems arise when using the reservation function in a broadcast receiver equipped with the functions as described above, specifically, in a broadcast receiver equipped with the reservation function in which the operational mode can be set to one of a plurality of operational modes.

The operational mode that is set when receiving a broadcast based on the stored reservation information is not always the same as the operational mode that is set when storing the reservation information. Therefore, a problem may arise when the broadcast content of the broadcast that has been received is outputted to and replayed with the screen and the speaker.

For example, in the case where the operational mode is set to the operational mode for User A when the reservation information is stored and the operational mode is set to the operational mode for User B when the broadcast is received based on the reservation information, the User B can unintentionally watch the broadcast content that the user A wants to watch, while the User A fails to watch or listen to the broadcast content he wants to watch. In addition, in the case where the operational mode is set to the operational mode for home when the reservation information is stored, and the operational mode is set to the operational mode for business when a broadcast is received based on the reservation information, it is not preferable that the broadcast content of the received broadcast be outputted to and replayed with the screen and the speaker.

SUMMARY OF THE INVENTION

The present invention has been conceived in light of the foregoing situations, and is to provide a broadcast receiver and a processing program thereof that suitably controls an output of a broadcast content in accordance with an operational mode that has been set.

In order to achieve the above-described purpose, in accordance with one aspect of the present invention, there is provided a broadcast receiver provided with a receiving means for receiving a broadcast and an output means for outputting a broadcast content, comprising: a setting means for setting an operational mode to one of a plurality of operational modes; a memory means for storing reservation information of the broadcast content by associating the reservation information with the operational mode set by the setting means when storing; a judgment means for judging, upon receiving the broadcast based on the reservation information that is stored in the memory means, whether or not the operational mode set by the setting means matches the stored operational mode associated with the reservation information; and an output control means for controlling output of the broadcast content by the output means based on a result of judgment by the judgment means.

In accordance with another aspect of the present invention, there is provided a computer-readable storage medium having a program of a broadcast receiver including receiving means for receiving broadcast and output means for outputting the broadcast content stored thereon that is executable by a computer, comprising: a setting processing for setting an operational mode to one of a plurality of operational modes; a memory processing for storing reservation information of the broadcast content by associating the reservation information with the operational mode set by the setting processing when storing; a judgment processing for judging, upon receiving the broadcast based on the reservation information stored in the memory processing, whether or not the operational mode set by the setting processing matches the stored operational mode associated with the reservation information; and an output control processing for controlling output of the broadcast content by the output processing based on a result of judgment by the judgment processing.

According to the present invention, in a broadcast receiver for which an operational mode can be set to one of a plurality of operational modes, there is an advantage that an output of a broadcast content can be suitably controlled in accordance with an operational mode that has been set.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 3 shows one example of a structure of a mode information memory section 1-3-1;

FIG. 4 shows one example of a structure of a mode change information memory section 1-3-2;

FIG. 5 shows one example of a structure of a reservation information memory section 1-3-3;

FIG. 6 shows one example of a structure of a record data memory section 1-3-4;

FIG. 14 shows one example of a structure of a mode information memory section 1-3-1;

DETAILED DESCRIPTION OF THE PREFERRED EMBODIMENTS

The present invention will be hereinafter described in detail with reference to the preferred embodiments shown in the accompanying drawings.

A. Structure of First Embodiment

Figure 1:
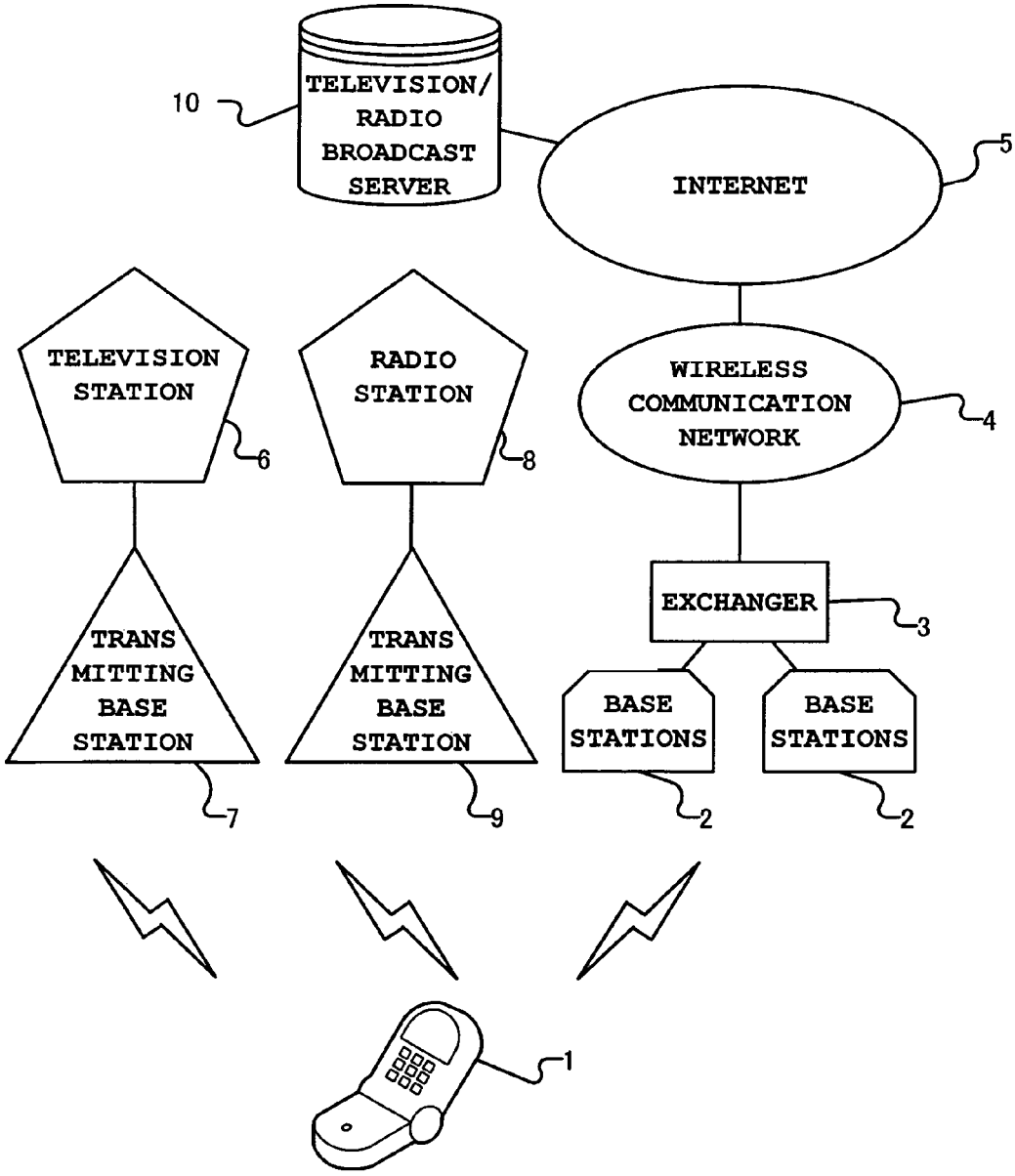
FIG. 1 is a block diagram showing a system structure in a mobile terminal apparatus to which a broadcast receiver according to a first embodiment of the present invention is applied.

FIG. 1 is a block diagram showing a system structure of a mobile terminal apparatus to which a broadcast receiver according to a first embodiment of the present invention is applied.

In FIG. 1, a mobile terminal apparatus 1 is connected to a wireless communication network 4 via base stations 2 and an exchanger 3, and is further connected to the Internet 5 via the wireless communication network 4. The mobile terminal apparatus 1 has a telephone call function, an e-mail function, and an Internet connection function (web access function).

In addition, the mobile terminal apparatus 1 has a function (that is equivalent to the function of receiving means) of receiving a digital television broadcast transmitted from a transmitting base station 7 of a television station 6 and a digital radio broadcast transmitted from a transmitting base station 9 of a radio station 8, and outputting the broadcast content thereof. The mobile terminal apparatus 1 also has a function (that is equivalent to the function of output means) of receiving the digital television broadcast and the digital radio broadcast from a television/radio broadcast server 10 connected to the Internet 5 via the exchanger 3 and the base stations 2, and outputting the broadcast content.

Figure 2:
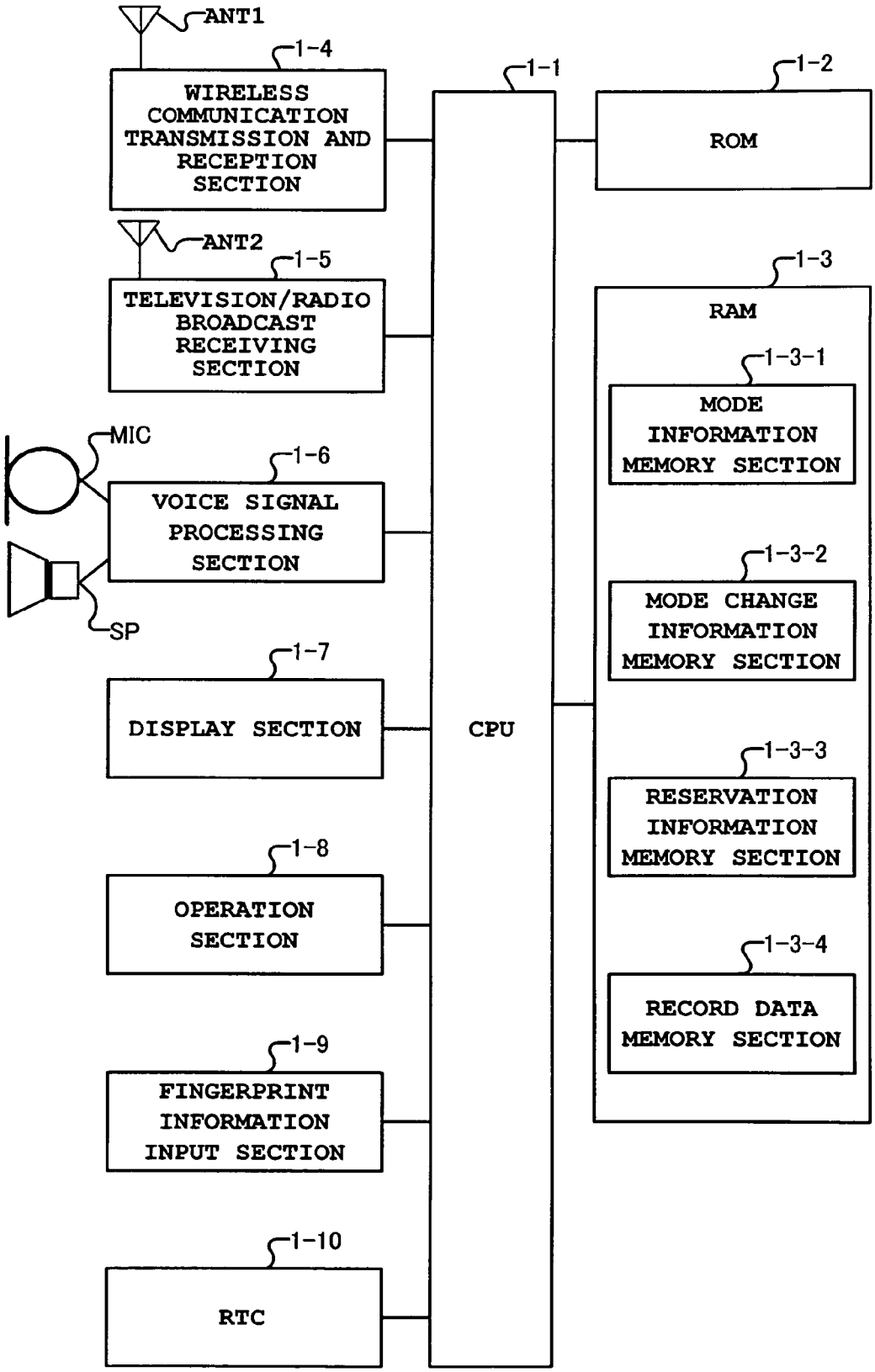
FIG. 2 is a block diagram showing a structure of a mobile terminal apparatus 1 according to the first embodiment.

Next, FIG. 2 is a block diagram showing the structure of the mobile terminal apparatus 1 according to the first embodiment.

In FIG. 2, the mobile terminal apparatus 1 includes a CPU 1-1, a ROM 1-2, a RAM 1-3, a wireless communication transmission and reception section 1-4, a television/radio broadcast receiving section 1-5, a voice signal processing section 1-6, a display section 1-7, an operation section 1-8, a fingerprint information input section 1-9 and an RTC 1-10.

The CPU 1-1 controls a whole operation of the mobile terminal apparatus 1 in accordance with various programs contained in the ROM 1-2.

The CPU 1-1 herein realizes the functions of the output means, setting means, judgment means, output control means and search means.

The program area in the ROM 1-2 stores programs for realizing the first embodiment in accordance with operational procedures shown in FIG. 7 to FIG. 12, FIG. 15 and FIG. 16, which will be described later.

The RAM 1-3 (memory means) is, for example, an internal memory having a work area, and is provided with a mode information memory section 1-3-1, a mode change information memory section 1-3-2, a reservation information memory section 1-3-3, a record data memory section 1-3-4 and the like, which will be described later. Note that, content stored in the RAM 1-3 is saved and stored in a nonvolatile memory (such as a flash memory) as necessary.

The wireless communication transmission and reception section 1-4, at the time of voice communication, outputs voice data received and demodulated via an antenna ANT 1 to the CPU 1-1 while it amplifies at high frequency a transmission signal acquired by modulating the voice data supplied from the CPU 1-1 and sends it from the antenna ANT 1. In addition, at the time of e-mail transmission and at the time of data communication including reception of the digital television broadcast and the digital radio broadcast from the television/radio broadcast server 10, the wireless communication transmission and reception section 1-4 transmits and receives the data with the base station 2 via the antenna ANT 1 under the control by the CPU 1-1.

The television/radio broadcast receiving section 1-5 (receiving means), in accordance with channel selection instructions provided by the CPU 1-1, receives and demodulates the television broadcast or the radio broadcast via an antenna ANT 2, and outputs a reception signal acquired by this reception and demodulation to the CPU 1-1.

The voice signal processing section 1-6, provided with a microphone MIC and a speaker SP, performs digital/analog conversion of voice data supplied from the CPU 1-1 to a voice signal, and replays and generates a sound from the speaker SP. Also, it performs analog/digital conversion of the voice signal outputted from the microphone MIC to the voice data and supplies the voice data to the CPU 1-1. In addition, when the television/radio broadcast receiving section 1-5 is in the receiving operation, or when the wireless communication transmission and reception section 1-4 is in the operation of receiving the digital television broadcast or the digital radio broadcast, after performing digital/analog conversion of the television voice data or the radio voice data supplied from the CPU 1-1, the voice signal processing section 1-6 amplifies it, and then replays and generates a sound from the speaker SP.

The display section 1-7, consisting of a color liquid crystal panel and a display driver, replays and displays various screens such as an idle screen under the control of the CPU 1-1. In addition, when the television/radio broadcast receiving section 1-5 is in the receiving operation, or when the wireless communication transmission and reception section 1-4 is in the operation of receiving the digital television broadcast or the digital radio broadcast, the display section 1-7 replays and displays video data in accordance with a display control signal supplied from the CPU 1-1.

The voice signal processing section 1-6 herein realizes the functions of the output means, and the display section 1-7 and the speaker SP realize the functions of the replay means.

Although the concept of "replay" is used for "replaying", the concept is not limited to this, and also includes "play" etc.

The operation section 1-8 performs operations such as power ON/OFF, dial inputting, character inputting, command inputting and the like. When, for example, a mode information registration operation, a mode change information setting operation, a mode change information setting operation, a reservation information memory operation, a mode setting operation or the like, which will be described later, is performed, the operation section 1-8 generates an event in accordance with such operations, and outputs the event to the CPU 1-1.

The fingerprint information input section 1-9, provided with a fingerprint sensor, generates a digital image in accordance with irregularity of a fingerprint (fingerprint image data), and outputs the fingerprint image data to the CPU 1-1.

The RTC 1-10 generates a real time clock which is used for clocking and a timer, and outputs it to the CPU 1-1.

The mode information memory section 1-3-1, as shown in an example in FIG. 3, stores a mode ID, a name, fingerprint information and a set flag for each operational mode. The mode ID refers to an ID for identifying the operational mode. The name refers to a name for identifying the operational mode, and particularly, a name of a user who is allowed to use the operational mode is used in this case. The fingerprint information refers to the fingerprint information of the user who is allowed to use the operational mode. The set flag refers to a flag that represents the operational mode that has been set. The set flag is set at "1" when the operational mode has been set, and the flag is set at "0" when the operational mode has not been set. Note that an "initial mode" with the mode ID "00" represents the operational mode that no one is allowed to use.

The mode change information memory section 1-3-2, as shown in an example in FIG. 4, stores a setting content (to/not to change) related to mode change by means of a flag. The set flag is set at "1" when the mode change has been set and the flag is set at "0" when the mode change has not been set. The operation referring to the mode change information memory section 1-3-2 will be described later.

The reservation information memory section 1-3-3, as shown in an example in FIG. 5, stores a reservation ID, a classification, a channel/frequency, and time information as the reservation information for each operational mode (mode ID). The reservation ID refers to an ID for identifying the reservation information. The classification refers to the information indicating whether the reservation information is for the television broadcast or for the radio broadcast. The channel/frequency refers to the information on the reserved channel of television when the classification is television, and on the frequency of the reserved radio when the classification is radio. The time information refers to the information that represents the reservation time.

The record data memory section 1-3-4, as shown in an example in FIG. 6, stores a record ID, the classification, the channel/frequency, the time information, and video/voice data for each operational mode (mode ID) as the recorded broadcast content. The record ID refers to an ID for identifying the recorded broadcast content. The classification refers to the information indicating whether the recorded broadcast content is the television broadcast or the radio broadcast. The channel/frequency refers to the information that represents the channel or frequency of the recorded broadcast content. The time information refers to the information that represents the time (time zone) of the recorded broadcast content. The video/voice data refers to the actual data of the recorded broadcast content.

B. Operation of First Embodiment

Next, the operation of the first embodiment as described above will be described.

Figure 7:
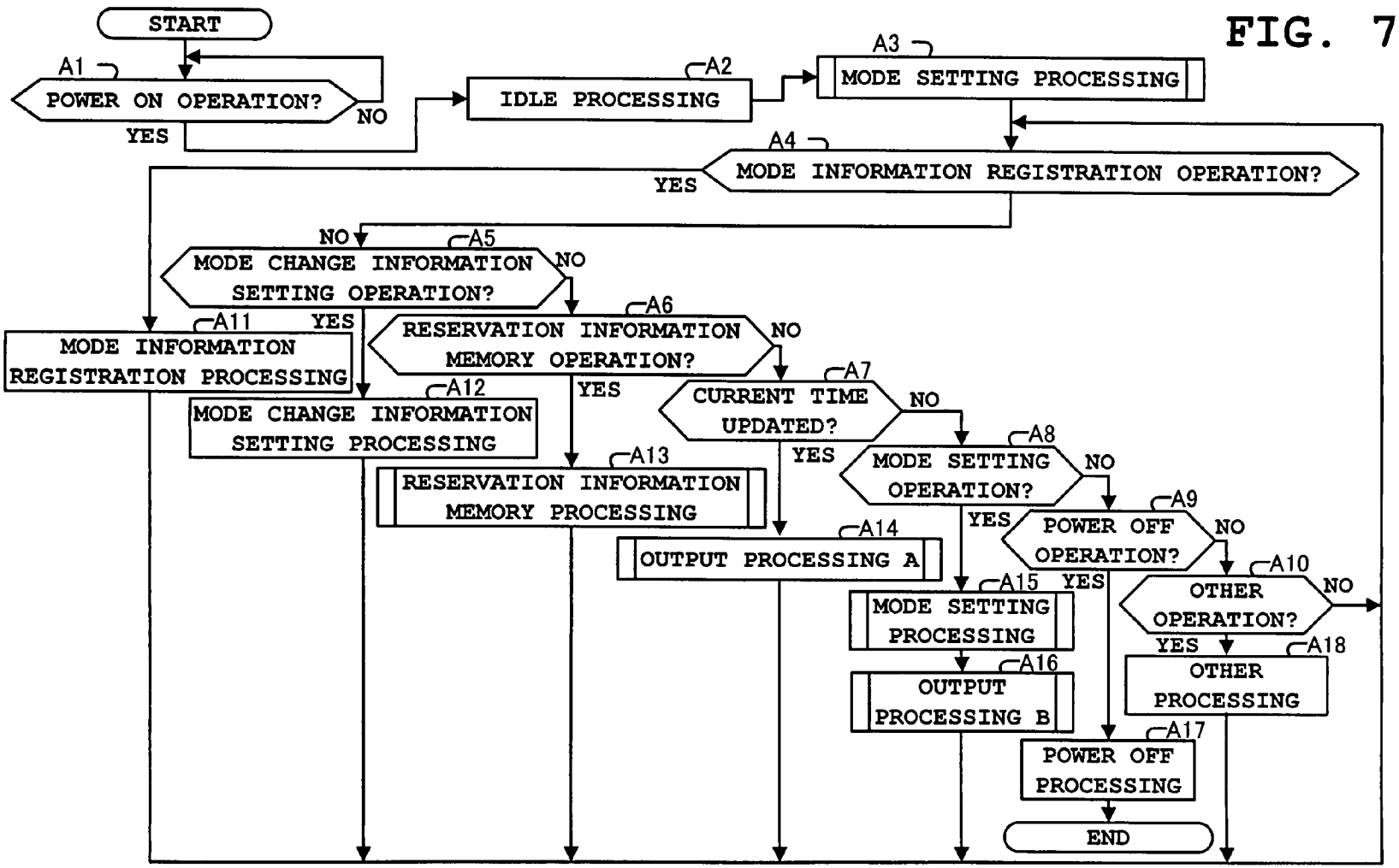
FIG. 7 is a flowchart (of a main routine) for explaining an operation of the mobile terminal apparatus 1 according to the first embodiment.

Herein, FIG. 7 is a flowchart (of a main routine) for explaining the operation of the mobile terminal apparatus 1 according to the first embodiment. First of all, the system judges whether or not a power ON operation is present (Step A1). When the power ON operation is present (YES at Step A1), the system turns the power ON, and performs idle processing such as a position registration operation into the wireless communication network 4 (Step A2). Next, the system performs the mode setting processing shown in FIG. 8 (Step A3). The mode setting processing will be described later.

Subsequently, the system judges whether or not an event of the registration operation of the mode information, the setting operation of the mode change information, the memory operation of the reservation information, the current time updating, the mode setting operation, the power OFF operation and other operation is present (Steps A4 to A10). When none of the events are generated (NO at all Steps A4 to A10), the system returns to Step A4. On the other hand, when either one of these events is generated, the system performs processing in accordance with the event that is generated. Hereinafter, the operation for each event will be described.

B-a. Registration Operation of Mode Information

When the registration operation of the mode information is performed (YES at Step A4), the system performs registration processing of the mode information (Step A11). The registration processing of the mode information refers to the processing of storing a new operational mode in the mode information memory section 1-3-1. The system assigns the mode ID to the name of the operational mode that has been inputted by a user operation and to the fingerprint information of the user that has been inputted from the fingerprint information input section 1-9, and stores the information with the set flag "0" in the mode information memory section 1-3-1. Subsequently, the system returns to Step A4.

B-b. Setting Operation of Mode Change Information

When the setting operation of the mode change information is performed (YES at Step A5), the system performs setting processing of the mode change information (Step A12). The setting processing of the mode change information refers to the processing of setting the content related to the mode change that is stored in the mode change information memory section 1-3-2. When "to changes" or "not to change" is selected by a user operation, the system stores the information with the flag "1". For the other case, the system stores the information with the flag "0". Subsequently, the system returns to Step A4.

B-c. Memory Operation of Reservation Information

Figure 9:
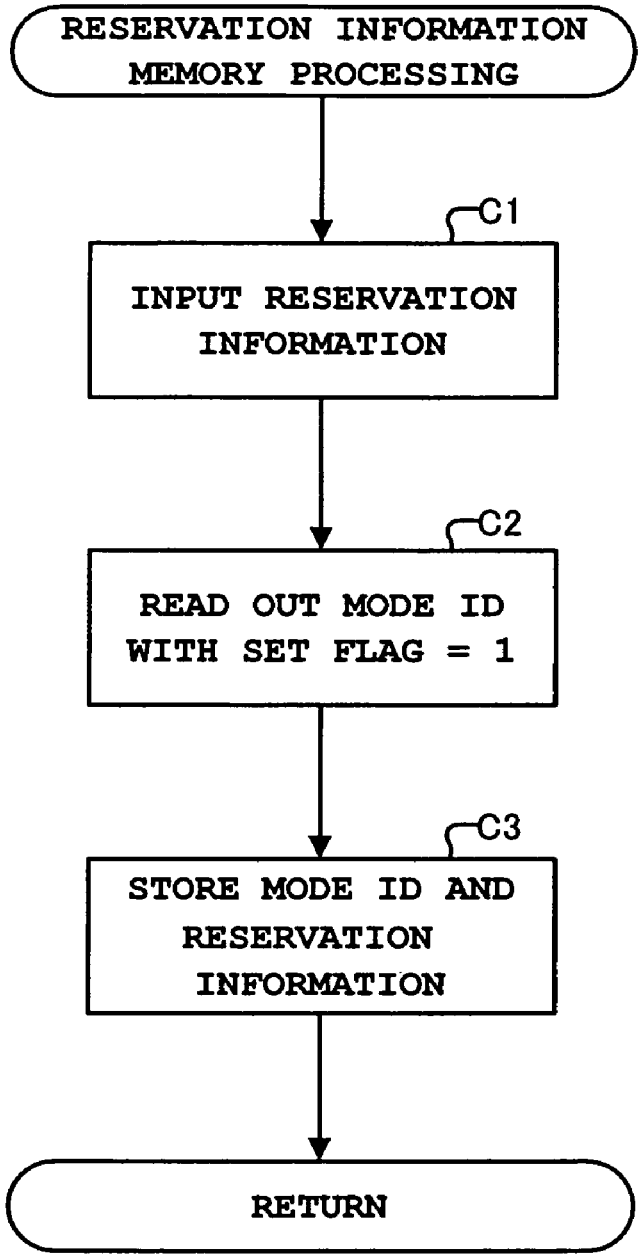
FIG. 9 is a flowchart for explaining an operation of reservation information memory processing.

When the memory operation of the reservation information is performed (YES at Step A6), the system performs the reservation information memory processing shown in FIG. 9 (Step A13). The reservation information memory processing will be described later. Subsequently, the system returns to Step A4.

B-d. Current Time Updating

Figure 10:
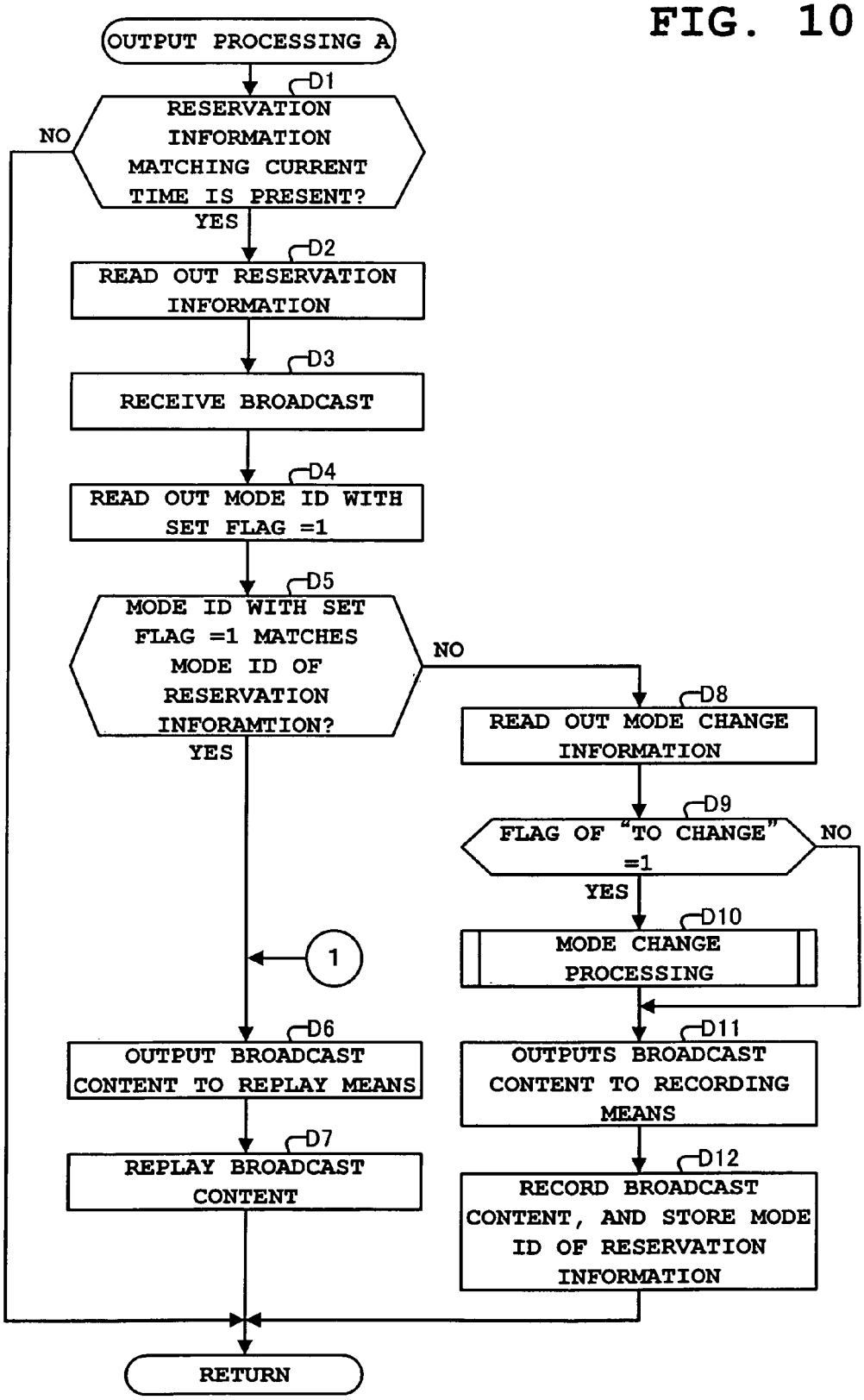
FIG. 10 is a flowchart for explaining an operation of output processing A.

When the current time is updated (YES at Step A7), the system performs output processing A shown in FIG. 10 (Step A14). The output processing A will be described later. Subsequently, the system returns to Step A4.

B-e. Mode Setting Operation

Figure 8:
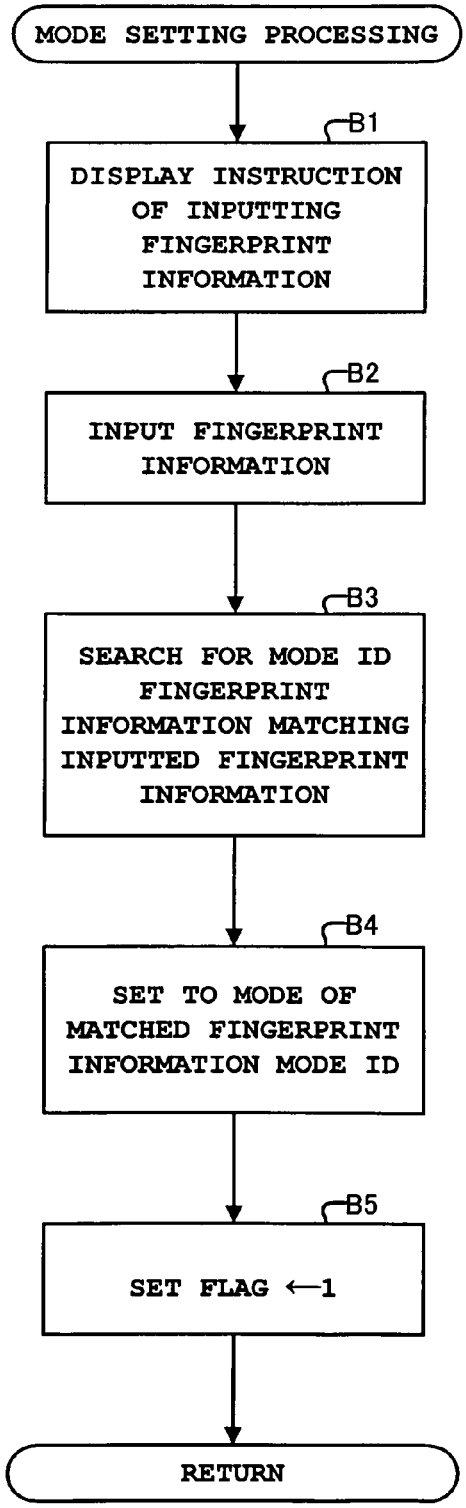
FIG. 8 is a flowchart for explaining an operation of mode setting processing.

When the mode setting operation is performed (YES at Step A8), the system performs the mode setting processing shown in FIG. 8 (Step A14). The mode setting processing will be described later. Next, the system performs output processing B shown in FIG. 12 (Step A15). The output processing B will be described later. Subsequently, the system returns to Step A4.

B-f. Power OFF Operation

When the power OFF operation is performed (YES at Step A9), the system performs the power OFF processing (Step A17), and ends the flowchart (of the main routine).

B-g. Other Operation

When other operation is performed (YES at Step A10), the system performs processing in accordance with the other operations (Step A18). Subsequently, the system returns to Step A4. The other operations refer to, for example, a transmitting operation of voice communication, e-mail transmission operation, the Internet connection operation and the like.

Next, FIG. 8 is a flowchart for explaining the operation of the mode setting processing as described above. In the mode setting processing, the system displays an instruction of inputting the fingerprint information of the user (Step B1), and when the fingerprint information of the user is inputted in the fingerprint information input section 1-9 in accordance with the instruction (Step B2), the system searches the fingerprint information stored in the mode information memory section 1-3-1 for the fingerprint information that matches the inputted fingerprint information (Step B3). Subsequently, the system sets the operational mode to the operational mode of the mode ID that is stored in the mode information memory section 1-3-1 in the manner so as to be associated with the search-matched fingerprint information (Step B4). Then, after setting the set flag of the mode ID stored in the mode information memory section 1-3-1 at "1", and setting the set flag of the other mode ID at "0" (Step B5), the system stores the information and returns to the main routine.

Next, FIG. 9 is a flowchart for explaining the operation of the reservation information memory processing as described above. In the reservation information memory processing, when the reservation information (the classification, the channel/frequency, the time information) is inputted by a user operation (Step C1), the system reads out the mode ID with the set flag "1" from the mode IDs that are stored in the mode information memory section 1-3-1 (Step C2), and associates the mode ID that has been read out with the reservation information that has been inputted. Then, after assigning them with the reservation ID, the system stores the mode ID and the reservation information in the reservation information memory section 1-3-3 (Step C3), and returns to the main routine.

Next, FIG. 10 is a flowchart for explaining the operation of the output processing A as described above. In the output processing A, the system judges whether or not the reservation information that has the time information matching the current time that has been updated at Step A7 of the main routine in FIG. 7 is present in the reservation information stored in the reservation information memory section 1-3-3 (Step D1). When reservation information that has the time information matching the current time is not present (NO at Step D1), the system returns to the main routine.

On the other hand, when reservation information that has the time information matching the current time is present (YES at Step D1), the system reads out the reservation information (Step D2), and receives the television broadcast or the radio broadcast based on the classification, the channel/frequency, and the time information of the reservation information (Step D3). Subsequently, the system reads out the mode ID with the set flag "1" from the mode IDs that are stored in the mode information memory section 1-3-1 (Step D4), and judges whether or not the mode ID with the set flag "1" that has been read out matches the mode ID stored in the reservation information memory section 1-3-3 in the manner so as to be associated with the reservation information that has been read out at Step D2 (Step D5).

When the both match each other (YES at Step D5), the system outputs the broadcast content of the television broadcast or the radio broadcast that the system is receiving to the speaker SP (replay means) via the voice signal processing section 1-6, and in the case of the television broadcast, simultaneously outputs it to the display section 1-7 (replay means) (Step D6). Subsequently, the system replays and generates a sound of the broadcast content (voice data)from the speaker SP, and in the case of the television broadcast, simultaneously replays and displays the broadcast content (video data) by the display section 1-7 (Step D7). Then, the system returns to the main routine.

On the other hand, when both do not match each other (NO at Step D5), the system reads out the mode change information stored in the mode change information memory section 1-3-2 (Step D8), and judges whether or not the flag of "to change" of the mode change information that has been read out is set at "1" (Step D9). When the flag of "to change" is set at "1" (YES at Step D9), the system performs the mode change processing shown in FIG. 11 (Step D10), and when the flag of "to change" is not set at "1" (NO at Step D9), the system does not perform the mode change processing. The mode setting processing will be described later.

Subsequently, the system outputs the broadcast content of the television broadcast or the radio broadcast that the system is receiving to the record data memory section 1-3-4 (recording means) (Step D11), and records the broadcast content thereof. Then, after associating the broadcast content with the mode ID that is stored in the reservation information memory section 1-3-3 in the manner so as to be associated with the reservation information that has been read at Step D2, the system stores the mode ID of the reservation information in the record data memory section 1-3-4, and returns to the main routine.

Figure 11:
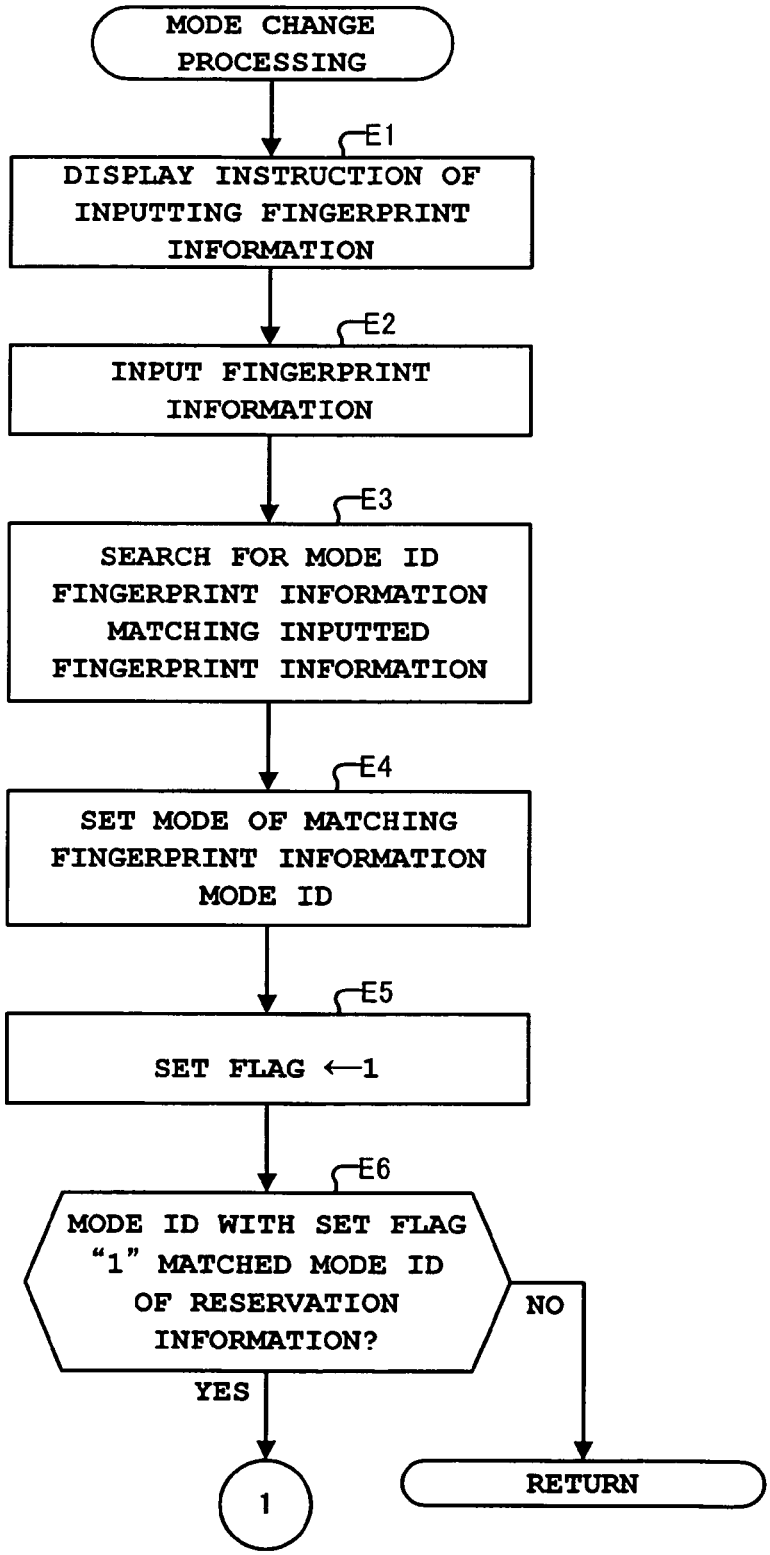
FIG. 11 is a flowchart for explaining an operation of mode change processing.

Next, FIG. 11 is a flowchart for explaining the operation of the mode change processing as described above.

In the mode change processing, the system displays an instruction of inputting the fingerprint information of the user (Step E1). When the fingerprint information of the user is inputted in the fingerprint information input section 1-9 in accordance with the instruction (Step E2), the system searches the fingerprint information stored in the mode information memory section 1-3-1 for the fingerprint information that matches the inputted fingerprint information (Step E3).

Subsequently, the system sets the operational mode to the operational mode of the mode ID that is stored in the mode information memory section 1-3-1 in the manner so as to be associated with the search-matched fingerprint information (Step E4), and stores the information, after setting the set flag of the mode ID stored in the mode information memory section 1-3-1 at "1" and setting the set flag of the other mode ID at "0" (Step E5).

Subsequently, the system judges whether or not the mode ID of the operational mode that has been set at Step E4 matches the mode ID that is stored in the reservation information memory section 1-3-3 in the manner so as to be associated with the reservation information that has been read at Step D2 of the output processing A in FIG. 10 (Step E6). When both match each other (YES at Step E6), the system returns to Step D6 of the output processing A in FIG. 10, and when both do not match each other (NO at Step E6), the system returns to Step D11 of the output processing A in FIG. 10.

Figure 12:
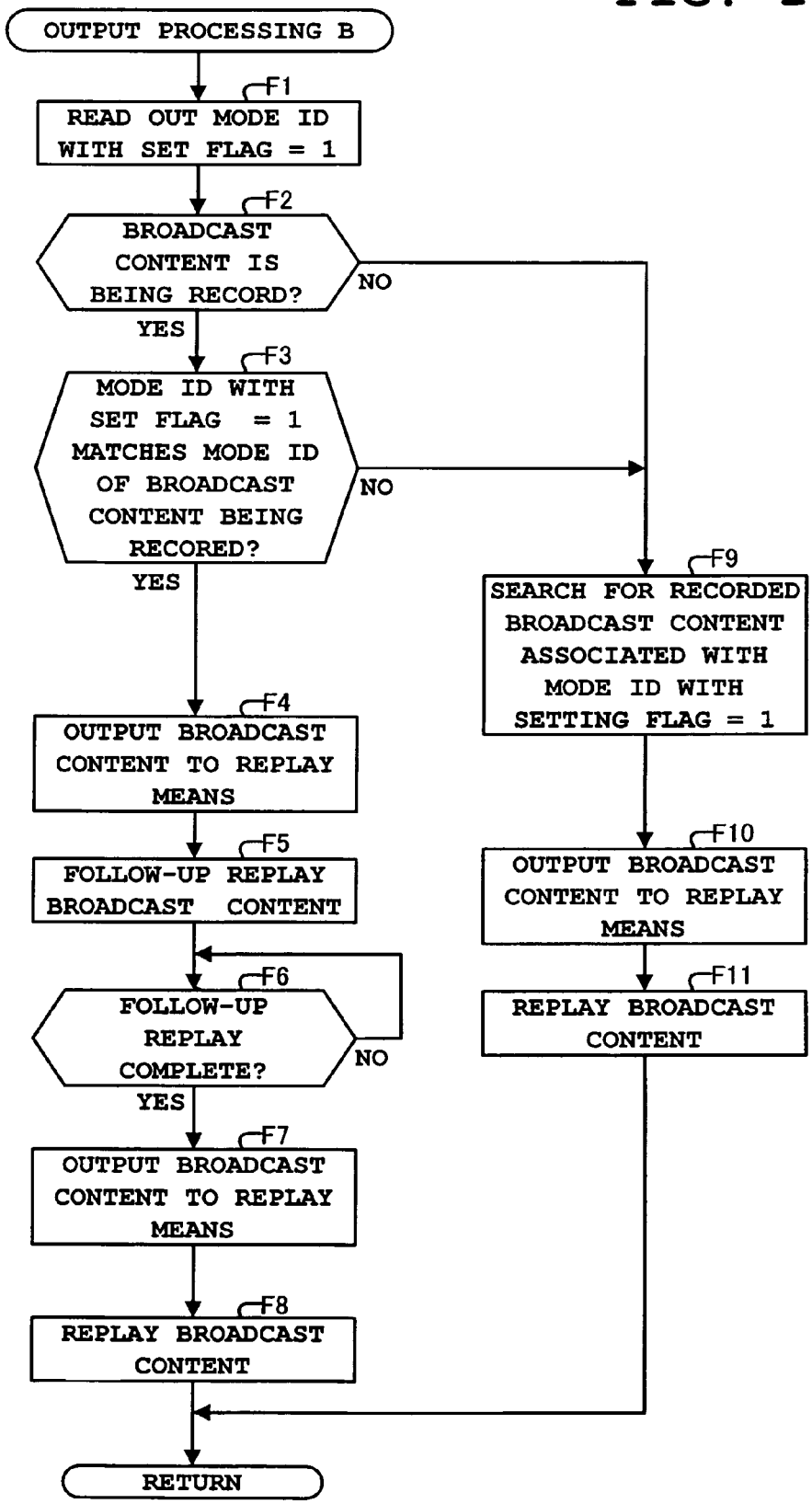
FIG. 12 is a flowchart for explaining an operation of output processing B.

Next, FIG. 12 is a flowchart for explaining the operation of the output processing B as described above.

In the output processing B, the system reads out the mode ID with the set flag "1" from the mode IDs that are stored in the mode information memory section 1-3-1 (Step F1), and judges whether or not the broadcast content is being recorded in the record data memory section 1-3-4 (Step F2). When the broadcast content is being recorded (YES at Step F2), the system judges whether or not the mode ID with the set flag "1" that has been read out at Step F1 matches the mode ID stored in the record data memory section 1-3-4 in the manner so as to be associated with the broadcast content that is being recorded (Step F3). When both match each other (YES at Step F3), the system outputs a portion where the broadcast content being recorded is recorded to the speaker SP (replay means) via the voice signal processing section 1-6, and in the case of the television broadcast, simultaneously outputs it to the display section 1-7 (replay means) (Step F4). Subsequently, the system replays and generates a sound of the broadcast content (voice data)from the speaker SP, and in the case of the television broadcast, simultaneously replays and displays the broadcast content (video data) by the display section 1-7 (Step F5). Note that although the replay herein refers to a replay which is called "follow-up replay" in which the playback speed is higher than a normal playback speed, the contents may be replayed at a normal playback speed.

Subsequently, the system waits for completion of the follow-up replay (Step F6). When the follow-up replay is complete (YES at Step F6), the system outputs the broadcast content of the television broadcast or the radio broadcast that the system is receiving to the speaker SP (replay means) via the voice signal processing section 1-6, and in the case of the television broadcast, outputs it to the display section 1-7 (replay means) (Step F7). Subsequently, the system replays and generates a sound of the broadcast content (voice data) from the speaker SP, and in the case of the television broadcast, simultaneously replays and displays the broadcast content (video data) by the display section 1-7 (Step F8).

On the other hand, in the case where the broadcast content is not being recorded at Step F2 (NO at Step F2) or where both do not match each other at Step F3 (NO at Step F3), the system searches the recorded broadcast contents that are stored in the record data memory section 1-3-4 for the broadcast content stored in the mode information memory section 1-3-1 in the manner so as to be associated with the mode ID with the set flag "1" (Step F9).

Subsequently, the system outputs the broadcast content that has been searched for to the speaker SP (replay means) via the voice signal processing section 1-6, and in the case of the television broadcast, outputs it to the display section 1-7 (replay means) (Step F10). Subsequently, the system replays and generates a sound of the broadcast content (voice data) from the speaker SP, and in the case of the television broadcast, simultaneously replays and displays the broadcast content (video data) by the display section 1-7 (Step F11). Then, the system returns to the main routine.

According to the first embodiment as described above, the system stores an operational mode in the mode information memory section for each user. Accordingly, an output of the broadcast content can be suitably controlled based on whether or not the operational mode when receiving the broadcast matches the operational mode stored so as to be associated with the reservation information, that is, whether or not the operational mode of the user when receiving the broadcast matches the operational mode of the user when storing the reservation information.

For example, assume that the operational mode when the reservation information is stored is XX Sato (father), and the operational mode when the broadcast is received based on the reservation information is YY Sato (child). In this case, it is possible to prevent the child from watching or listening to the broadcast by suppressing the output of the broadcast content to the replay means. In addition, the father can check the recorded broadcast content later by outputting the broadcast content to the recording means, thereby preventing failure to watch or listen to the broadcast content.

In addition, according to the first embodiment as described above, the system identifies the operational mode using the fingerprint information as the identification information for identifying the user. Accordingly, a risk that an operational mode of a certain user is used by another user can be reduced.

C. Structure of Second Embodiment

Next, the second embodiment of the present invention will be described.

In the first embodiment as described above, the broadcast content should be outputted to the speaker SP, the display section 1-7 or the record data memory section 1-3-4. However, in the second embodiment, the broadcast content should be outputted to an external replay apparatus via an external replay apparatus connection section 1-11, or to an external recording apparatus via an external recording apparatus connection section 1-12. The external replay apparatus connection section 1-11 and the external recording apparatus connection section 1-12 will be described later.

In addition, in the first embodiment as described above, the operational mode should be set for each user who is allowed to use the operational mode, and the operational mode should be identified using the fingerprint information of the user. In the second embodiment, however, the operational mode should be set in accordance with a usage, and the operational mode should be identified using a password.

In the second embodiment, the system structure (FIG. 1), the mode change information memory section 1-3-2 (FIG. 4), the reservation information memory section 1-3-3 (FIG. 5), the record data memory section 1-3-4 (FIG. 6), the main routine (FIG. 7), the reservation information memory processing (FIG. 9), the output processing A (FIG. 10) and the output processing B (FIG. 12) are the same as those in the first embodiment as described above. Therefore, the explanation thereof will be omitted.

Note that, in the second embodiment, the CPU 1-1 realizes the functions of the setting control means in addition to the functions described in the first embodiment.

In addition, in FIG. 13 to FIG. 16 to be described later, the same numerals will be given to the elements that are essentially the same or that have the same names as the elements in the first embodiment as described above, and the description there of will be omitted. Hereinafter, a description will be given mainly of the characteristic portions of the second embodiment.

Figure 13:
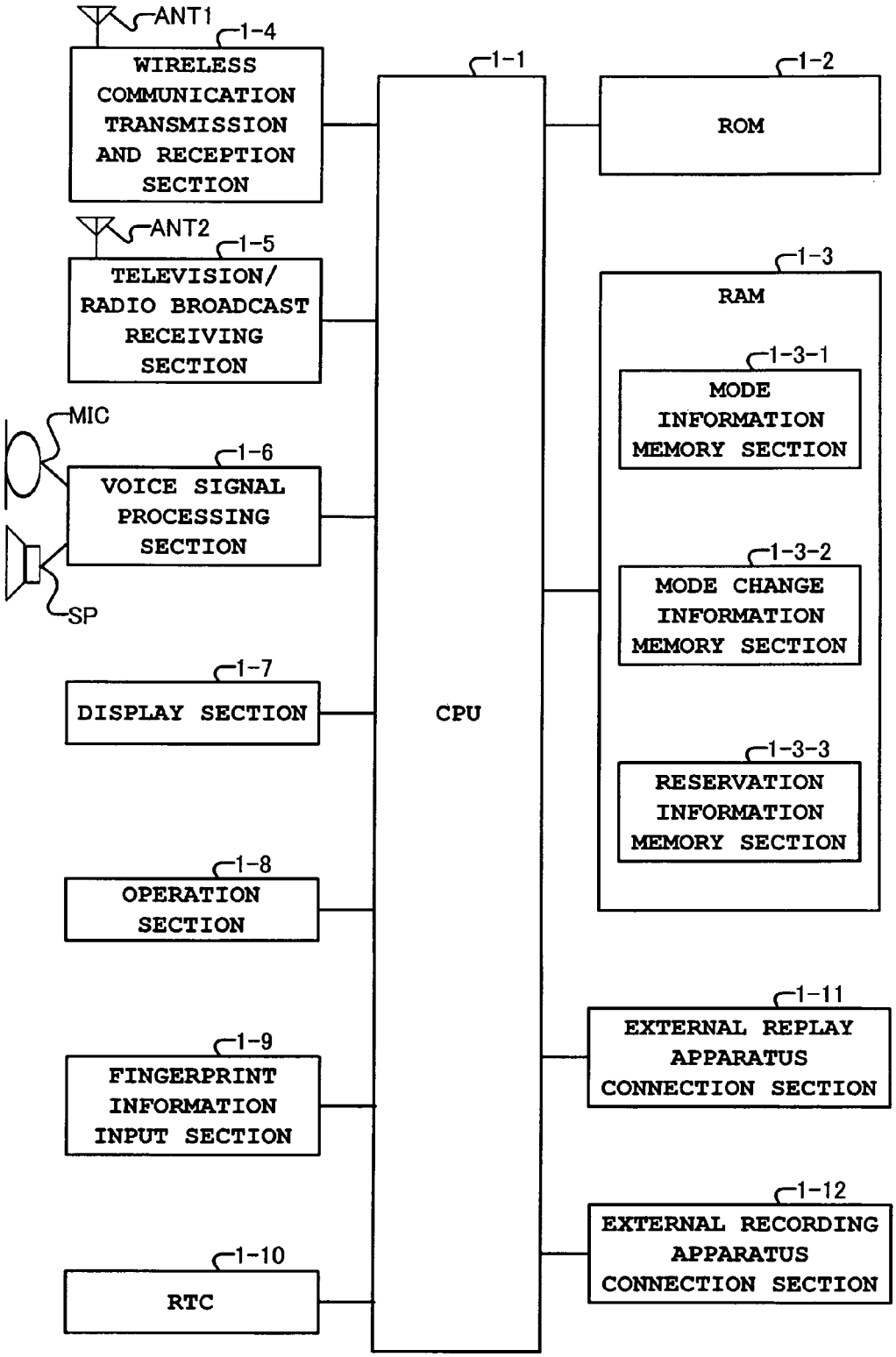
FIG. 13 is a block diagram showing a structure of a mobile terminal apparatus 1 to which a broadcast receiver according to a second embodiment is applied.

FIG. 13 is a block diagram showing the structure of the mobile terminal apparatus 1 to which the broadcast receiver according to the second embodiment is applied. In FIG. 13, the record data memory section 1-3-4 present in the first embodiment as described above is not provided. Instead, the mobile terminal apparatus 1 includes the external replay apparatus connection section 1-11 and the external recording apparatus connection section 1-12.

The external replay apparatus connection section 1-11 includes a video output terminal, a voice output terminal and an information output terminal as the external output terminal, and an external replay apparatus (replay means) such as a video monitor, an external speaker and the like can be connected thereto. The external replay apparatus connection section 1-11 outputs the broadcast content and the information such as a control signal and various data to the external replay apparatus connected thereto via the external output terminal.

The external recording apparatus connection section 1-12 includes a video output terminal and a voice output terminal as the external output terminal, and an external recording apparatus (recording means) such as a DVD recorder, a hard disk recorder, a voice recorder and the like can be connected thereto. The external recording apparatus connection section 1-12 outputs the broadcast content to the external recording apparatus connected thereto via the external output terminal.

Next, FIG. 14 is an example of mode information that is stored in the mode information memory section 1-3-1 according to the second embodiment. The system stores the mode ID, the name, the password and the set flag for each operational mode. The mode ID refers to an ID for identifying the operational mode. The name refers to a name for identifying the operational mode, and particularly in this case, the usage of the operational mode is used as the name. The password refers to a password that is used when the operational mode is set. A user who knows the password is allowed to set the operational mode and use it. The set flag refers to a flag representing the operational mode that has been set. The set flag is set at "1" when the operational mode has been set, and the set flag is set at "0" when the operational mode has not been set.

Figure 15:
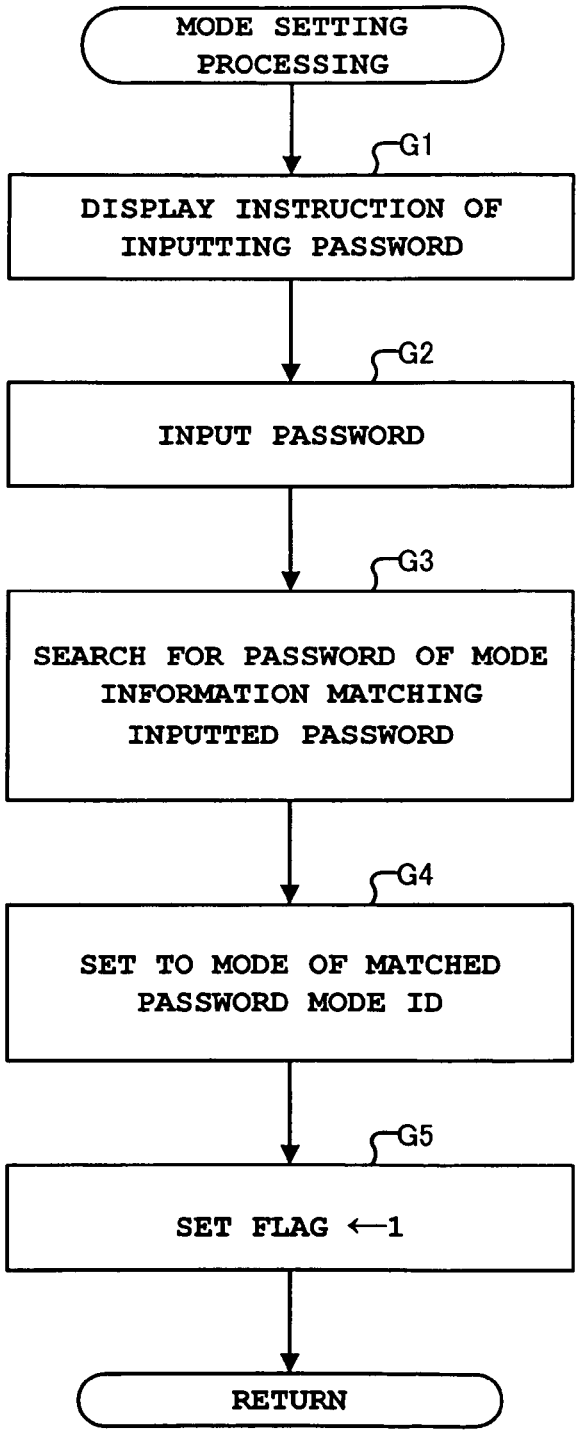
FIG. 15 is a flowchart for explaining an operation of mode setting processing.

Next, FIG. 15 is a flowchart for explaining the operation of the mode setting processing in the second embodiment.

In the mode setting processing, the system displays the instruction of inputting a password (Step G1). When the password is inputted to the operation section 1-8 in accordance with the instruction (Step G2), the system searches the passwords that are stored in the mode information memory section 1-3-1 for the password that matches the password that has been inputted (Step G3).

Subsequently, the system sets the operational mode to the operational mode of the mode ID stored in the mode information memory section 1-3-1 in the manner so as to be associated with the search-matched password (Step G4), and stores the information after setting the set flag of the mode ID stored in the mode information memory section 1-3-1 at "1" and setting the set flag of the other mode ID at "0" (Step G5). Then, the system returns to the main routine.

Figure 16:
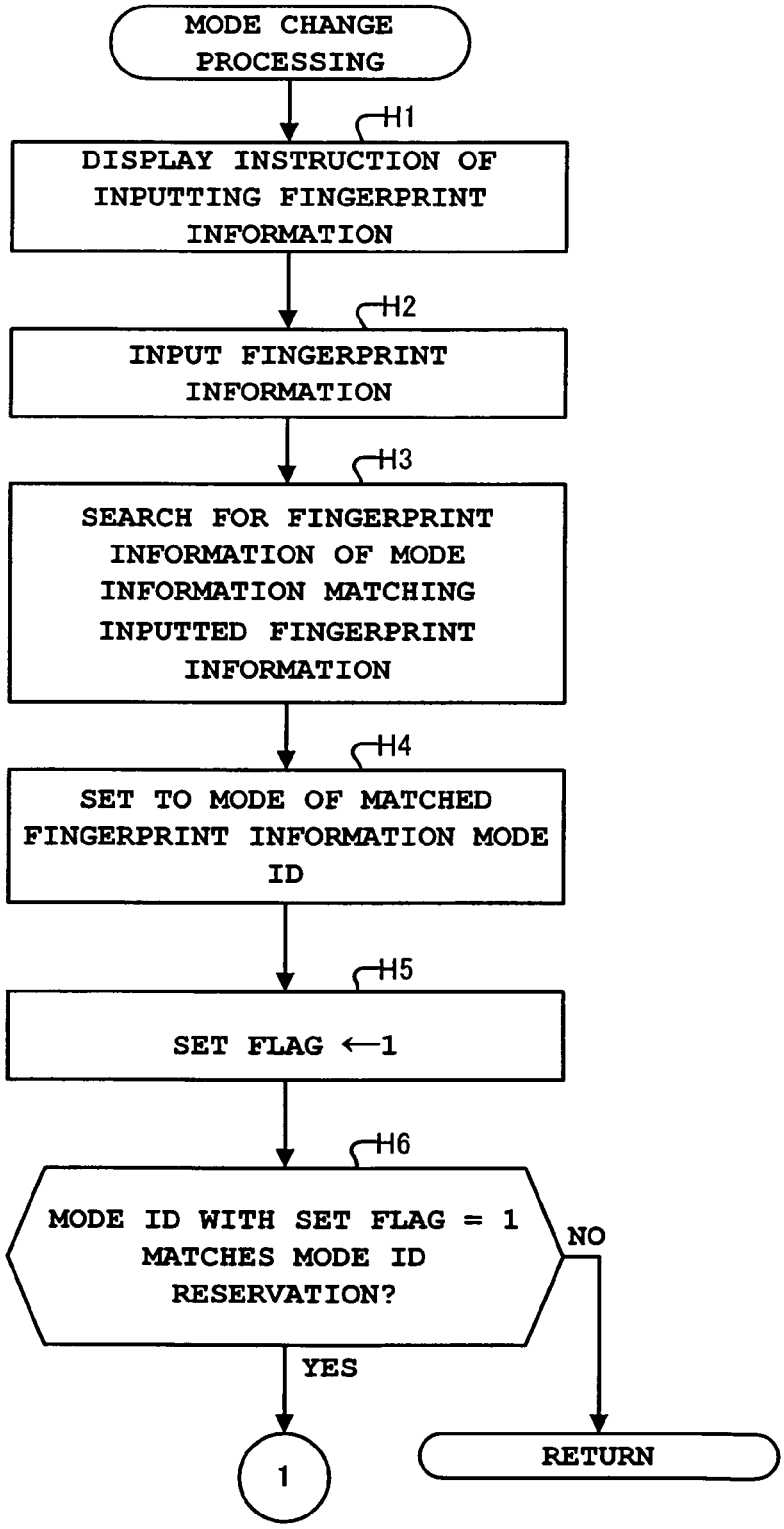
FIG. 16 is a flowchart for explaining an operation of mode change processing.

Next, FIG. 16 is a flowchart for explaining the operation of the mode change processing in the second embodiment.

In the mode change processing, the system displays an instruction of inputting a password (Step H1). When the password is inputted to the operation section 1-8 in accordance with the instruction (Step H2), the system searches the passwords that are stored in the mode information memory section 1-3-1 for the password matching the password that has been inputted (Step H3).

Subsequently, the system sets the operational mode to the operational mode of the mode ID stored in the mode information memory section 1-3-1 in the manner so as to be associated with the search-matched password (Step H4), and stores the information after setting the set flag of the mode ID stored in the mode information memory section 1-3-1 at "1" and setting the set flag of the other mode ID at "0" (Step H5).

Subsequently, the system judges whether or not the mode ID of the operational mode that has been set at Step H4 matches the mode ID stored in the reservation information memory section 1-3-3 in the manner so as to be associated with the reservation information that has been read at Step D2 of the output processing A in FIG. 10 (Step H6). When the both match each other (YES at Step H6), the system returns to Step D6 of the output processing A in FIG. 10, and when the both do not match each other (NO at Step H6), the system returns to Step D11 of the output processing A in FIG. 10.

According to the second embodiment as described above, the system stores an operational mode in accordance with the usage in the mode information memory section 1-3-1. Accordingly, an output of the broadcast content can be suitably controlled based on whether or not the operational mode when receiving the broadcast matches the operational mode stored so as to be associated with the reservation information, that is, whether or not the operational mode for the usage when receiving the broadcast matches the operational mode for the usage when storing the reservation information.

For example, assume the case where the operational mode when the reservation information is stored is the operational mode for home and the operational mode when the broadcast is received based on the reservation information is the operational mode for business. Since being at work seems unsuitable for replaying the broadcast content, it is possible to inhibit replaying the broadcast content by suppressing an output of the broadcast content to the replay means. In addition, outputting the broadcast content to the recording means enables checking the recorded broadcast content, thereby preventing failure to watch or listen to the broadcast content.

Furthermore, according to the second embodiment as described above, the operational mode is identified using the password. Accordingly, the risk that the operational mode is used by a third party who does not know the password can be reduced.

Alternatively, according to the first embodiment and the second embodiment as described above, the system judges whether or not the operational mode that has been set when receiving the broadcast based on the reservation information matches the operational mode stored so as to be associated with the reservation information, and controls an output of the broadcast content based on the result of judgment. Accordingly, an output of the broadcast content can be suitably controlled in accordance with the operational mode that has been set.

Alternatively, according to the first embodiment and the second embodiment as described above, when judged that the operational mode that has been set when receiving the broadcast matches the operational mode stored so as to be associated with the reservation information, the system outputs the broadcast content of the broadcast to the replay means, and when judged that they do not match each other, the system suppresses an output of the broadcast content to the replay means. Accordingly, it is possible to replay the broadcast content in the circumstances that are suitable for replaying the broadcast content and not to replay the broadcast content in the circumstances that are not suitable for replaying.

Alternatively, according to the first embodiment and the second embodiment as described above, when judged that the operational mode that has been set when receiving the broadcast matches the operational mode stored so as to be associated with the reservation information, the system suppresses an output of the broadcast content to the recording means, and when judged that they do not match each other, the system outputs the broadcast content to the recording means. Accordingly, it is possible not to record the broadcast content in the circumstances that are suitable for replaying the broadcast content thereby reducing extra recording processing, and to record the broadcast content in the circumstances that are not suitable for replaying thereby preventing failure to watch the broadcast content.

Alternatively, according to the first embodiment and the second embodiment as described above, when judged that the operational mode that has been set when receiving the broadcast matches the operational mode stored so as to be associated with the reservation information, the system outputs the broadcast content to the replay means, and when judged that they do not match each other, the system outputs the broadcast content to the recording means. Accordingly, it is possible to replay the broadcast content in the circumstances that are suitable for replaying the broadcast content, and to record the broadcast content in the circumstances that are not suitable for replaying thereby preventing failure to watch or listen to the broadcast content.

Alternatively, according to the first embodiment and the second embodiment as described above, when judged that the operational mode that has been set when receiving the broadcast does not match the operational mode stored so as to be associated with the reservation information, the system changes the operational mode that has been set, and when the operational mode after the change matches the operational mode stored so as to be associated with the reservation information, the system outputs the broadcast content to the replay means. Accordingly, it is possible to replay the broadcast content when the user intentionally changes the operational mode even in the circumstances that are not suitable for replaying the broadcast content, thereby preventing failure to watch the broadcast content.

For example, even when a user different from the user who has stored the reservation information is using the mobile terminal apparatus, the system can replay the broadcast content by changing the operational mode to the operational mode of the user who has stored the reservation information. In addition, even when the mobile terminal apparatus is used for a usage different from the usage when the reservation information is stored, the broadcast content can be replayed by changing the operational mode, if the user places priority on replaying the broadcast content.

In addition, assume the case where the broadcast content is being recorded when the operational mode is set to one of the operational modes. According to the first embodiment and the second embodiment as described above, when the operational mode that has been set matches the operational mode stored in the manner so as to be associated with the reservation information of the broadcast content that is being recorded, the system should output the broadcast content that is being recorded to the replay means. Accordingly, when the circumstances have become suitable for replaying the broadcast content, it is possible to record the broadcast content without performing a particular replay operation, thereby preventing failure to watch the broadcast content.

For example, when the same user as the user who has stored the reservation information uses the mobile terminal apparatus, it is possible to replay the broadcast content being recorded that is associated with the reservation information that the user has stored. In addition, when using the mobile terminal apparatus for the same usage as the usage when storing the reservation information, it is possible to replay the broadcast content being recorded that is associated with the reservation information stored when the mobile terminal apparatus is used for the usage.

Alternatively, according to the first embodiment and the second embodiment as described above, the system searches the recorded broadcast contents for the broadcast content of the reservation information stored so as to be associated with the operational mode that has been set, and outputs the broadcast content that has been searched for to the replay means when the operational mode is set to one of the operational modes. Accordingly, it is possible to replay the broadcast content that is suitable for replay in the operational mode that has been set among the recorded broadcast contents without performing the particular replay operation, thereby preventing failure to watch the broadcast content.

For example, when a certain user uses the mobile terminal apparatus, the user can replay the broadcast content associated with the reservation information stored by the user among the recorded broadcast contents. Alternatively, when a user uses the mobile terminal apparatus for a certain usage, it is possible to replay the broadcast content associated with the reservation information stored when the mobile terminal apparatus is used for the usage among the recorded broadcast contents.

Note that, in the first embodiment as described above, as shown in an example in FIG. 3, a plurality of operational modes of a plurality of users as well as "the initial mode" are set as the plurality of operational mode. However, the number of operational modes of the user may be one (or for a single user). In this case, the operational mode and "the initial mode" together constitute the plurality of operational modes.

In addition, in the first embodiment as described above, as shown in an example in FIG. 3, the operational modes associated with the individual users are set as the operational mode that has been set for each user. However, the operational mode may be set for a group of a plurality of users in the family, for example, the operational mode for the parents, the operational mode for the children, or the like.

In addition, in the first embodiment as described above, as shown in an example in FIG. 3, to identify the operational mode, the fingerprint information is used as the identification information for identifying the user. However, the identification information is not limited to fingerprint, and instead, the biological information such as voiceprint, or the password may be used. Furthermore, numerals and character strings such as ID may be used to reduce the identification processing.

In addition, in the first embodiment and the second embodiment as described above, the broadcast receiver is applied to the mobile terminal apparatus. However, an apparatus to which the broadcast receiver is applied is not limited to the broadcast receiver. For example, an apparatus to which the broadcast receiver is applied may be an electronic device such as a tuner, a video recorder, a DVD recorder, a hard disk recorder, a voice recorder, or PDA having the functions of receiving the television broadcast and the radio broadcast.

Furthermore, although the computer program product of the broadcast receiver which is a preferred embodiment of the present invention is stored in the memory (for example, ROM, etc.) of the broadcast receiver, this processing program is stored on a computer-readable medium and should also be protected in the case of manufacturing, selling, etc. of only the program. In that case, the method of protecting the program with a patent will be realized by the form of the computer-readable medium on which the computer program product is stored.

While the present invention has been described with reference to the preferred embodiments, it is intended that the invention be not limited by any of the details of the description therein but includes all the embodiments which fall within the scope of the appended claims.

What is claimed is:

1. A broadcast receiver provided with a receiving unit for receiving a broadcast, an output unit for outputting broadcast content, and a plurality of operational modes associated with identification information that identifies at least one of a user and a usage, the broadcast receiver comprising:

a setting unit for setting an operational mode to one of the plurality of operational modes;

a storing control unit for storing in a storing section reservation information including time information that indicates a time for receiving the broadcast by the receiving unit;

a first judgment unit for judging the operational mode set by the setting unit when the reservation information is stored by the storing control unit;

a second judgment unit for judging the operational mode set by the setting unit when the broadcast is received based on the time information included in the reservation information stored by the storing control unit;

a comparison unit for comparing the operational mode judged by the first judgment unit with the operational mode judged by the second judgment unit; and an output control unit for controlling the output unit to output the broadcast content of the broadcast received by the receiving unit to a replay unit for replaying the broadcast content when the operational modes match as a result of the comparison by the comparison unit and controlling the output unit to suppress output of the broadcast content to the replay unit when the operational modes do not match.

2. A broadcast receiver provided with a receiving unit for receiving a broadcast, an output unit for outputting broadcast content, and a plurality of operational modes associated with identification information that identifies at least one of a user and a usage, the broadcast receiver comprising:

a setting unit for setting an operational mode to one of the plurality of operational modes;

a storing control unit for storing in a storing section reservation information including time information that indicates a time for receiving the broadcast by the receiving unit;

a first judgment unit for judging the operational mode set by the setting unit when the reservation information is stored by the storing control unit;

a second judgment unit for judging the operational mode set by the setting unit when the broadcast is received based on the time information included in the reservation information stored by the storing control unit;

a comparison unit for comparing the operational mode judged by the first judgment unit with the operational mode judged by the second judgment unit; and an output control unit for controlling the output unit to suppress output of the broadcast content to a recording unit for recording the broadcast content when the operational modes match as a result of the comparison by the comparison unit and controlling the output unit to output the broadcast content of the broadcast received by the receiving unit to the recording unit when the operational modes do not match.

3. A broadcast receiver provided with a receiving unit for receiving a broadcast, an output unit for outputting broadcast content, and a plurality of operational modes for controlling output of the broadcast content by the output unit, the broadcast receiver comprising:

a setting unit for setting an operational mode to one of the plurality of operational modes;

a storing control unit for storing in a storing section reservation information including time information that indicates a time for receiving the broadcast by the receiving unit;

a first judgment unit for judging the operational mode set by the setting unit when the reservation information is stored by the storing control unit;

a second judgment unit for judging the operational mode set by the setting unit when the broadcast is received based on the time information included in the reservation information stored by the storing control unit;

a comparison unit for comparing the operational mode judged by the first judgment unit with the operational mode judged by the second judgment unit; and an output control unit for controlling the output unit to output the broadcast content of the broadcast received by the receiving unit to a replay unit for replaying the broadcast content when the operational modes match as a result of the comparison by the comparison unit and controlling the output unit to suppress output of the broadcast content to the replay unit when the operational modes do not match.

4. A broadcast receiver provided with a receiving unit for receiving a broadcast, an output unit for outputting broadcast content, and a plurality of operational modes for controlling output of the broadcast content by the output unit, the broadcast receiver comprising:

a setting unit for setting an operational mode to one of the plurality of operational modes;

a storing control unit for storing in a storing section reservation information including time information that indicates a time for receiving the broadcast by the receiving unit;

a first judgment unit for judging the operational mode set by the setting unit when the reservation information is stored by the storing control unit;

a second judgment unit for judging the operational mode set by the setting unit when the broadcast is received based on the time information included in the reservation information stored by the storing control unit;

a comparison unit for comparing the operational mode judged by the first judgment unit and the operational mode judged by the second judgment unit; and an output control unit for controlling the output unit to suppress output of the broadcast content to a recording unit for recording the broadcast content when the operational modes match as a result of the comparison by the comparison unit and controlling the output unit to output the broadcast content of the broadcast received by the receiving unit to the recording unit when the operational modes do not match.

5. The broadcast receiver according to claim 1, further comprising:

a setting control unit for controlling the setting unit to change the operational mode set by the setting unit when the operational modes do not match as a result of the comparison by the comparison unit, wherein when the operational mode is changed by the setting control unit and the changed operational mode matches the operational mode judged by the first judgment unit, the output control unit controls the output unit to output the broadcast content of the broadcast received by the receiving unit to the replay unit.

6. The broadcast receiver according to claim 2, wherein, when the operational mode is set to the one of the operational modes by the setting unit while the broadcast content is being recorded by the recording unit and the set operational mode matches the operational mode judged by the first judgment unit, the output control unit controls the output unit to output the broadcast content being recorded by the recording unit to a replay unit for replaying the broadcast content.

7. The broadcast receiver according to claim 2, wherein the storing control unit stores the broadcast content recorded by the recording unit by associating the broadcast content with the operational mode judged by the first judgment unit, wherein the broadcast receiver further comprises a search unit for searching the broadcast content recorded by the recording unit for broadcast content stored based on an association with the operational mode set by the setting unit, and wherein when the operational mode is set to the one of the operational modes by the setting unit, the output control unit controls the output unit to output the broadcast content associated with the operational mode set by the setting unit to a replay unit for replaying the broadcast content associated with the operational mode set by the setting unit.

8. A non-transitory computer readable medium storing a program which when executed by a computer of a broadcast receiver provided with a receiving unit for receiving a broadcast, an output unit for outputting broadcast content, and a plurality of operational modes associated with identification information that identifies at least one of a user and a usage, causes the broadcast receiver to perform:

a setting function for setting an operational mode to one of the plurality of operational modes;

a storing control function for storing in a storing section reservation information including time information that indicates a time for receiving the broadcast by the receiving unit;

a first judgment function for judging the operational mode set by the setting function when the reservation information is stored by the storing control function;

a second judgment function for judging the operational mode set by the setting function when the broadcast is received based on the time information included in the reservation information stored by the storing control function;

a comparison function for comparing the operational mode judged by the first judgment function with the operational mode judged by the second judgment function; and an output control function for controlling the output unit to output the broadcast content of the broadcast received by the receiving unit to a replay unit for replaying the broadcast content when the operational modes match as a result of the comparison by the comparison function and controlling the output unit to suppress output of the broadcast content to the replay unit when the operational modes do not match.

9. A non-transitory computer readable medium storing a program which when executed by a computer of a broadcast receiver provided with a receiving unit for receiving a broadcast, an output unit for outputting broadcast content, and a plurality of operational modes associated with identification information that identifies at least one of a user and a usage, causes the broadcast receiver to perform:

a setting function for setting an operational mode to one of the plurality of operational modes;

a storing control function for storing in a storing section reservation information including time information that indicates a time for receiving the broadcast by the receiving unit;

a first judgment function for judging the operational mode set by the setting function when the reservation information is stored by the storing control function;

a second judgment function for judging the operational mode set by the setting function when the broadcast is received based on the time information included in the reservation information stored by the storing control function;

a comparison function for comparing the operational mode judged by the first judgment function with the operational mode judged by the second judgment function; and an output control function for controlling the output unit to suppress output of the broadcast content to a recording unit for recording the broadcast content when the operational modes match as a result of the comparison by the comparison function and controlling the output unit to output the broadcast content of the broadcast received by the receiving unit to the recording unit when the operational modes do not match.

10. A non-transitory computer readable medium storing a program which when executed by a computer of a broadcast receiver provided with a receiving unit for receiving a broadcast, an output unit for outputting broadcast content, and a plurality of operational modes for controlling output of the broadcast content by the output unit, causes the broadcast receiver to perform:

a setting function for setting an operational mode to one of the plurality of operational modes;

a storing control function for storing in a storing section reservation information including time information that indicates a time for receiving the broadcast by the receiving unit;

a first judgment function for judging the operational mode set by the setting function when the reservation information is stored by the storing control function;

a second judgment function for judging the operational mode set by the setting function when the broadcast is received based on the time information included in the reservation information stored by the storing control function;

a comparison function for comparing the operational mode judged by the first judgment function with the operational mode judged by the second judgment function; and an output control function for controlling the output unit to output the broadcast content of the broadcast received by the receiving unit to a replay unit for replaying the broadcast content when the operational modes match as a result of the comparison by the comparison function and controlling the output unit to suppress output of the broadcast content to the replay unit when the operational modes do not match.

11. A non-transitory computer readable medium storing a program which when executed by a computer of a broadcast receiver provided with a receiving unit for receiving a broadcast, an output unit for outputting broadcast content, and a plurality of operational modes for controlling output of the broadcast content by the output unit, causes the broadcast receiver to perform:

a setting function for setting an operational mode to one of the plurality of operational modes;

a storing control function for storing in a storing section reservation information including time information that indicates a time for receiving the broadcast by the receiving unit;

a first judgment function for judging the operational mode set by the setting function when the reservation information is stored by the storing control function;

a second judgment function for judging the operational mode set by the setting function when the broadcast is received based on the time information included in the reservation information stored by the storing control function;

a comparison function for comparing the operational mode judged by the first judgment function with the operational mode judged by the second judgment function; and an output control function for controlling the output unit to suppress output of the broadcast content to a recording unit for recording the broadcast content when the operational modes match as a result of the comparison by the comparison function and controlling the output unit to output the broadcast content of the broadcast received by the receiving unit to the recording unit when the operational modes do not match.

12. The broadcast receiver according to claim 2, further comprising:

a setting control unit for controlling the setting unit to change the operational mode set by the setting unit when the operational modes do not match as a result of the comparison by the comparison unit, wherein when the operational mode is changed by the setting control unit and the changed operational mode matches the operational mode judged by the first judgment unit, the output control unit controls the output unit to output the broadcast content of the broadcast received by the receiving unit to the replay unit.

13. The broadcast receiver according to claim 4, wherein, when the operational mode is set to the one of the operational modes by the setting unit while the broadcast content is being recorded by the recording unit and the set operational mode matches the operational mode judged by the first judgment unit, the output control unit controls the output unit to output the broadcast content being recorded by the recording unit to a replay unit for replaying the broadcast content.

14. The broadcast receiver according to claim 4, wherein the storing control unit stores the broadcast content recorded by the recording unit by associating the broadcast content with the operational mode judged by the first judgment unit, wherein the broadcast receiver further comprises a search unit for searching the broadcast content recorded by the recording unit for broadcast content stored based on an association with the operational mode set by the setting unit, and wherein when the operational mode is set to the one of the operational modes by the setting unit, the output control unit controls the output unit to output the broadcast content associated with the operational mode set by the setting unit to a replay unit for replaying the broadcast content associated with the operational mode set by the setting unit.

* * * * *